US006409534B1

(12) United States Patent
Weisz-Margulescu

(10) Patent No.: US 6,409,534 B1
(45) Date of Patent: Jun. 25, 2002

(54) COAX CABLE CONNECTOR ASSEMBLY WITH LATCHING HOUSING

(75) Inventor: Adam Weisz-Margulescu, Thornhill (CA)

(73) Assignee: Tyco Electronics Canada Ltd., Ontario (CA)

( * ) Notice: Subject to any disclaimer, the term of this patent is extended or adjusted under 35 U.S.C. 154(b) by 0 days.

(21) Appl. No.: 09/756,160

(22) Filed: Jan. 8, 2001

(51) Int. Cl.[7] ..... H01R 13/62
(52) U.S. Cl. ..... 439/367; 439/357; 439/731
(58) Field of Search ..... 439/357, 358, 439/367–370, 578, 688, 692, 731

(56) References Cited

U.S. PATENT DOCUMENTS

| | | | | |
|---|---|---|---|---|
| 2,727,759 | A | | 12/1955 | Elliott |
| 2,877,437 | A | | 3/1959 | Flanagan, Jr. |
| 3,435,848 | A | | 4/1969 | Johnston |
| 3,684,321 | A | | 8/1972 | Hundhausen et al. |
| 3,953,098 | A | | 4/1976 | Avery et al. |
| 4,008,941 | A | * | 2/1977 | Smith |
| 4,017,139 | A | | 4/1977 | Nelson |
| 4,374,606 | A | | 2/1983 | Lathrop |
| 4,412,717 | A | | 11/1983 | Monroe |
| 4,443,054 | A | | 4/1984 | Ezawa et al. |
| 4,919,627 | A | | 4/1990 | Cable |
| 5,062,808 | A | | 11/1991 | Hosler, Sr. |
| 5,316,494 | A | | 5/1994 | Flanagan et al. |
| 5,482,477 | A | | 1/1996 | Michael |
| 5,547,400 | A | | 8/1996 | Wright |
| 5,561,269 | A | | 10/1996 | Robertson et al. |
| 5,595,499 | A | | 1/1997 | Zander et al. |
| 5,601,446 | A | * | 2/1997 | Wright ..... 439/357 |
| 5,695,357 | A | | 12/1997 | Wright |
| 5,741,159 | A | | 4/1998 | Wright |
| 5,816,853 | A | * | 10/1998 | Buekers et al. ..... 439/521 |
| 5,842,872 | A | | 12/1998 | Hosler, Sr. et al. |
| 6,036,540 | A | | 3/2000 | Beloritsky |
| 6,149,460 | A | | 11/2000 | Straeb et al. |

OTHER PUBLICATIONS

AMP Customer Drawing—C–414948—1996.
AMP Customer Drawing—C–415134—1995.

* cited by examiner

*Primary Examiner*—Khiem Nguyen

(57) ABSTRACT

A coaxial cable assembly 2 consists of a plug coaxial connector subassembly 4 and a jack coaxial connector subassembly 6. A plug connector 10 and a jack connector 50 are respectively mounted in molded plug and jack housings 20 and 60 respectively. The plug and jack housings 20 and 60 include a latching beam 66 that is attachable to a raised bum 26 on the other connector. The maximum force for disengaging the two subassemblies is greater than the engagement force because the bump includes a sloping forward surface 36 and a steep rear surface 38. When used with connectors 10 and 50 that have equal mating and unmating forces, the total unmating force exceeds the mating force. The latches and the connectors are also positioned so that maximum mating forces of the two separate latching systems do not overlap, thus keeping the total mating force within acceptable limits.

21 Claims, 10 Drawing Sheets

COAX CABLE CONNECTOR ASSEMBLY WITH LATCHING HOUSING

BACKGROUND OF THE INVENTION

1. Field of the Invention

This invention is related to coaxial electrical connectors. More particularly, this invention is related to mating plug and jack coaxial electrical connectors that are used to connect two coaxial cables and include a means for locking the two connectors together so that the force required to disconnect the plug and jack coaxial connectors is greater than the force required to mate the two mating connectors. Furthermore, this invention is related to the use of plug and jack coaxial connectors that are located in molded outer housings. This invention is also related to the use of coaxial electrical connectors in automotive applications.

2. Description of the Prior Art

Coaxial or RF plug and jack electrical connectors typically include means for connecting center conductors in separate coaxial cables and for connecting the outer shield or braid in the two cables. In some cases, the center conductor in one of the cables is connected directly to a socket terminal in the other coaxial connector, but often a pin is attached or crimped to the center conductor in the cable. The center contact and the braid contact in each connector or terminal are typically separated by a cylindrical dielectric surrounding the center contact. The outer contact is typically attached to the braid or shield of a coaxial cable by crimping a ferrule to the braid after the end of the cable has been prepared or stripped.

Once plug and jack coaxial connectors have been attached to sections of a coaxial cable, a number of conventional means have been employed to mate the plug connector to the jack connector. One connector may employ an outer ring with internal threads which can then be screwed to the mating connector with external mating threads. BNC style coaxial connectors employ a laterally facing pin or post on one connector that is captured within a slot on the mating connector. However, both of these coaxial connector configurations require that mating connectors must be mounted by rotating one connector relative to its mating connector. This approach may be satisfactory for many traditional applications, such as field assembly of two coaxial cables, for example connecting two cables in a commercial or residential building. However, when the coaxial cables are used in a larger component or subassembly, such as a harness in an automobile or motor vehicle, that is assembled in a large scale production environment, screwing the two coaxial connectors together is undesirable. Indeed assembly workers have complained that assembly of components in this manner can cause problems with carpal tunnel syndrome.

One alternative to coaxial connectors that are mated by screwing one connector to another, is to employ a snap-on or quick connect, quick disconnect configuration in which one coaxial connector is simply pushed into mating engagement with the other coaxial connector without mutual rotation. These prior art snap-on connectors typically include a plurality of screw machined or die cast spring fingers in a cylindrical configuration. Adjacent spring fingers are separated by slots and include mating ridges adjacent their free ends. The individual spring fingers can be radially when pushed onto a mating connector having a diameter that differs from the normal neutral position of the spring fingers. The spring fingers can be deflected inwardly or outwardly, depending on whether they a inserted into a bore in cylindrical sleeve or over the exterior of a cylindrical barrel. When the quick connect, quick disconnect, snap-on connectors are fully mated, the spring fingers are received within a groove or recess on the mating connector, so that the spring fingers return to their neutral position. Examples of coaxial connectors of this general type are shown in U.S. Pat. Nos. 4,017,139; 4,412,717; 5,842,872; and 6,036,540. Although conventional coaxial connectors of this type do not require rotational movement for mating, the disconnect force is typically approximately the same as the connection or mating force. Thus quick connect, quick disconnect coaxial connectors cannot be locked when mated, so that a significantly greater force is required to unmate or disconnect the coaxial connectors than was required to mate them. The fact that these prior art connectors cannot be locked together can cause problems when they are used in automotive applications or in harness assemblies for use in similar applications, because the connectors can be inadvertently dislodged during assembly or pulled apart when a force is applied to one of the coaxial cables, possibly as part of a later assembly operation. Vibration due to movement of the automobile or similar apparatus can also cause disengagement of the mated coaxial connectors.

Prior art coaxial connectors, of either the rotationally mated or snap-on type are not typically positioned within molded or plastic housings. Exceptions include multiple position connectors in which multiple coaxial cables attached to separate cables are mounted in multi-position housing that is to be mated with printed circuit board connectors located in an array. U.S. Pat. Nos. 4,008,941 and 5,842,872 show multi-position configurations of this type. However, these patents show coaxial contacts that are inserted into cavities that extend completely through one piece housings. U.S. Pat. No. 5,547,400 shows a printed circuit board type coaxial connector that is mounted in a two piece housing.

SUMMARY OF THE INVENTION

One of the objects of the invention disclosed and claimed herein is to provide a mating coaxial cable assembly in which the force required to unmate the two connectors is substantially greater than the force required to mate the two connectors so that the connectors can be said to be in a locked configuration when mated. Of course, it should still be possible to unlock or unmate the two connectors when sufficient force is applied, but this unmating force or the manipulation of the connectors to disconnect them, should not occur during their normal use, and it should require more than the application of a tensile force to disengage the two connector assemblies.

Another objective of this invention is employ an assembly that uses a standard, tested, and reliable mating interface or configuration for the coaxial connectors or terminals used to connect two coaxial conductors, such as two cables or one cable to be connected to one printed circuit board. A standard cable termination technique should also be retained.

This invention should also be suitable for use in automotive applications and for use on cables that are part of harness assemblies that are used in motor vehicles and other similar applications. When installed as part of an automotive assembly operation, the coaxial connectors comprising this invention should be mated and unmated in substantially the same manner as other electrical connectors. It is also important that the mating force of connectors used in such applications not exceed the mating force typically required to mate other noncoaxial electrical connectors used as part of the same assembly, so that they can be reliably installed and do not require special care on the part of the installer.

These and other objectives can be achieved by the coaxial connector assembly disclosed herein that includes a plug coaxial assembly matable with a jack coaxial assembly. The plug coaxial assembly includes a plug coaxial connector and a molded plug housing, which is formed by two plug housing components latched together around the plug coaxial connector. The jack coaxial assembly includes a jack coaxial connector and a molded jack housing, which is formed of two jack housing components latched together around the jack coaxial connector. The plug coaxial connector is latched to the jack coaxial connector when mated, and the molded plug housing is separately latched to the molded jack housing when the plug coaxial assembly is mated to the jack coaxial assembly.

In this assembly, the plug housing includes a plug latch and the jack housing including a jack latch. The plug latch is matable with the jack latch with an engagement force. The plug latch is unmated from the jack latch with a disengagement force, normally by deflecting a mating latch. The disengagement force is greater than the engagement force so that the plug coaxial connector and the jack coaxial connector can be locked in a mating configuration.

Spring fingers and a groove in mating coaxial connectors are positioned relative to latching members or housing surrounding these coaxial connectors so that a first mating force peak attributable to mating of the two coaxial connectors occurs prior to a second mating force peak attributable to mating the two latching members. The first and second mating force peaks do not overlap as the first subassembly is mated to the second subassembly, so that the maximum mating force can be maintained within acceptable limits.

DETAILED DESCRIPTION OF THE PREFERRED EMBODIMENT

Figure 1:
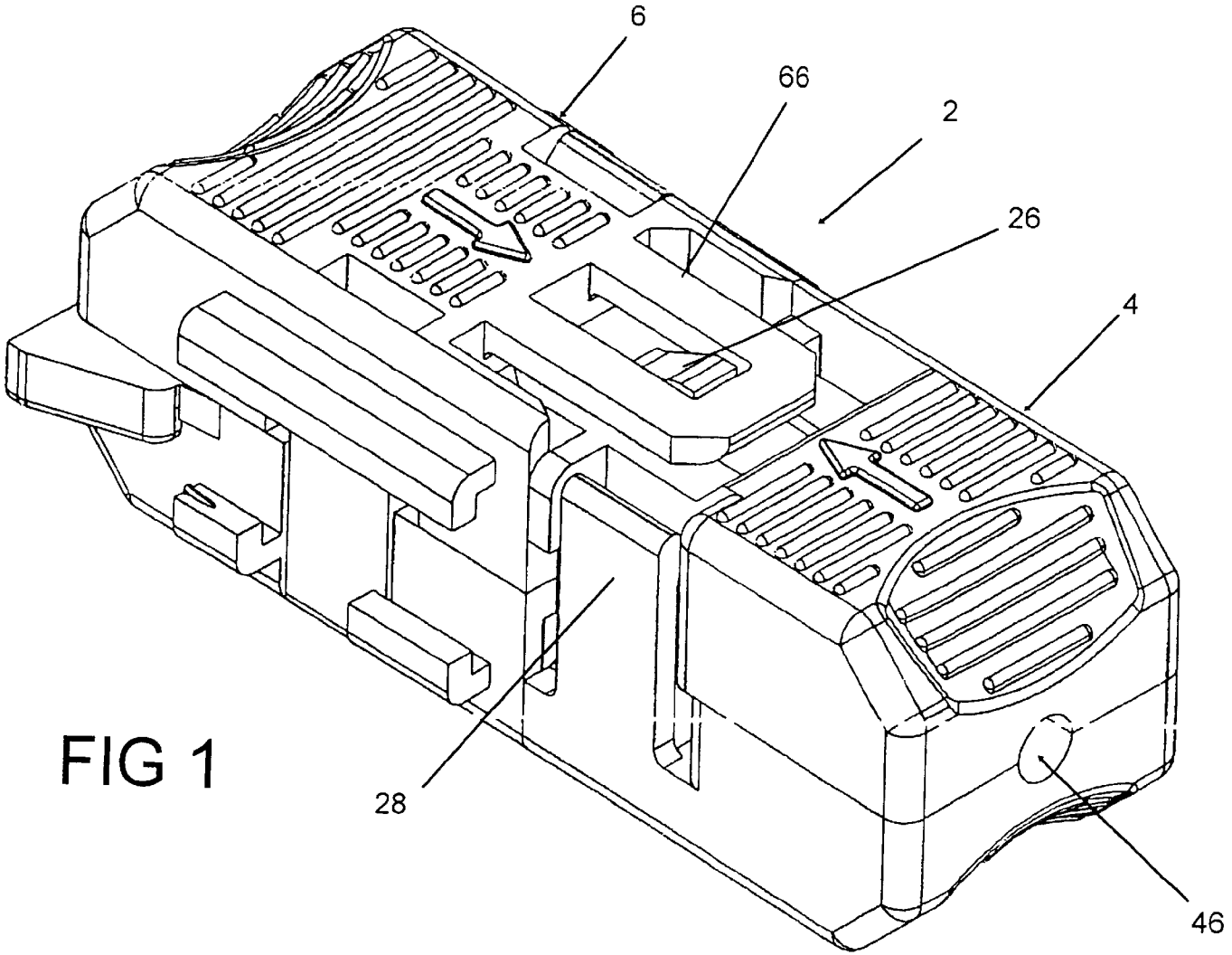
FIG. 1 is a view of mated plug and jack coaxial connector assemblies according to this invention, in which each assembly includes a coaxial electrical connector and a surrounding molded housing.
Figure 2A:
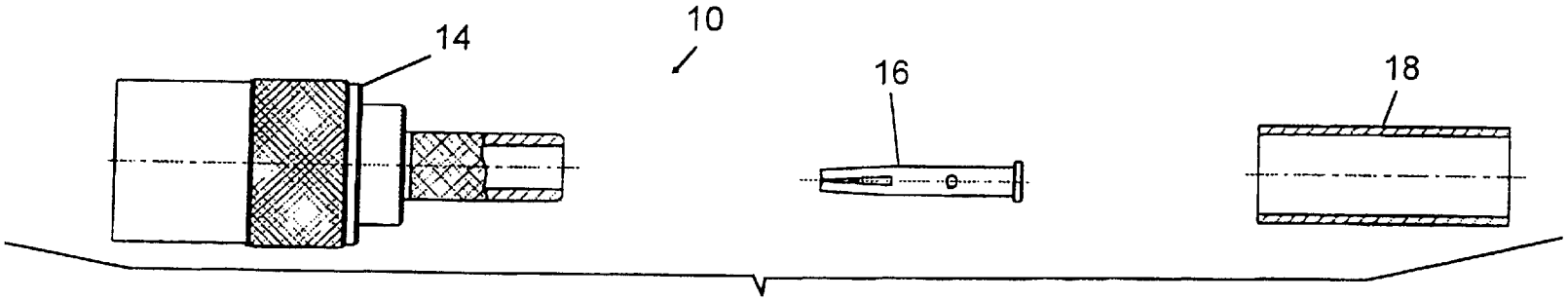
FIG. 2A is an exploded view of the main components of a plug coaxial connector.
Figure 3:
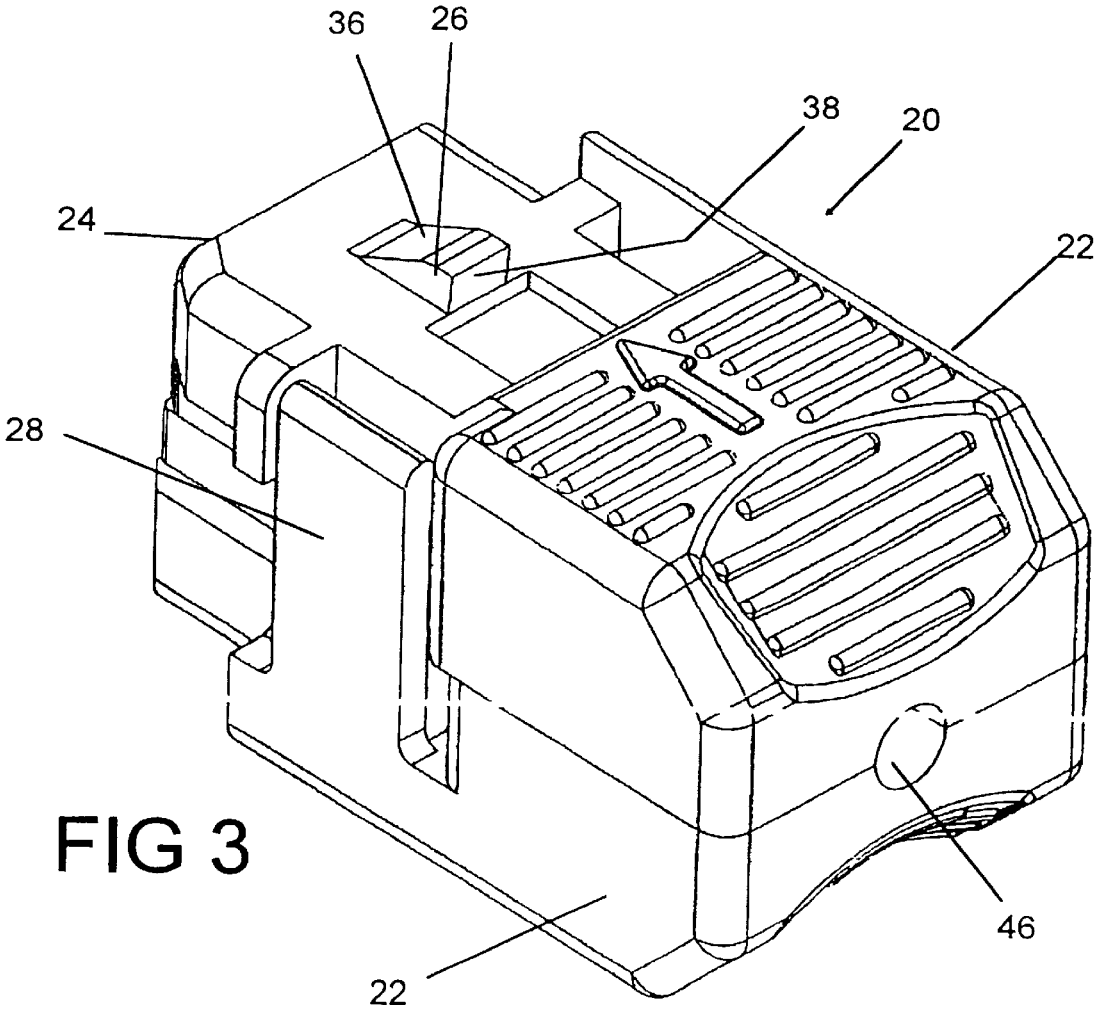
FIG. 3 is a three dimensional view of the plug connector molded housing formed of two mating hermaphroditic housing components.
Figure 4:
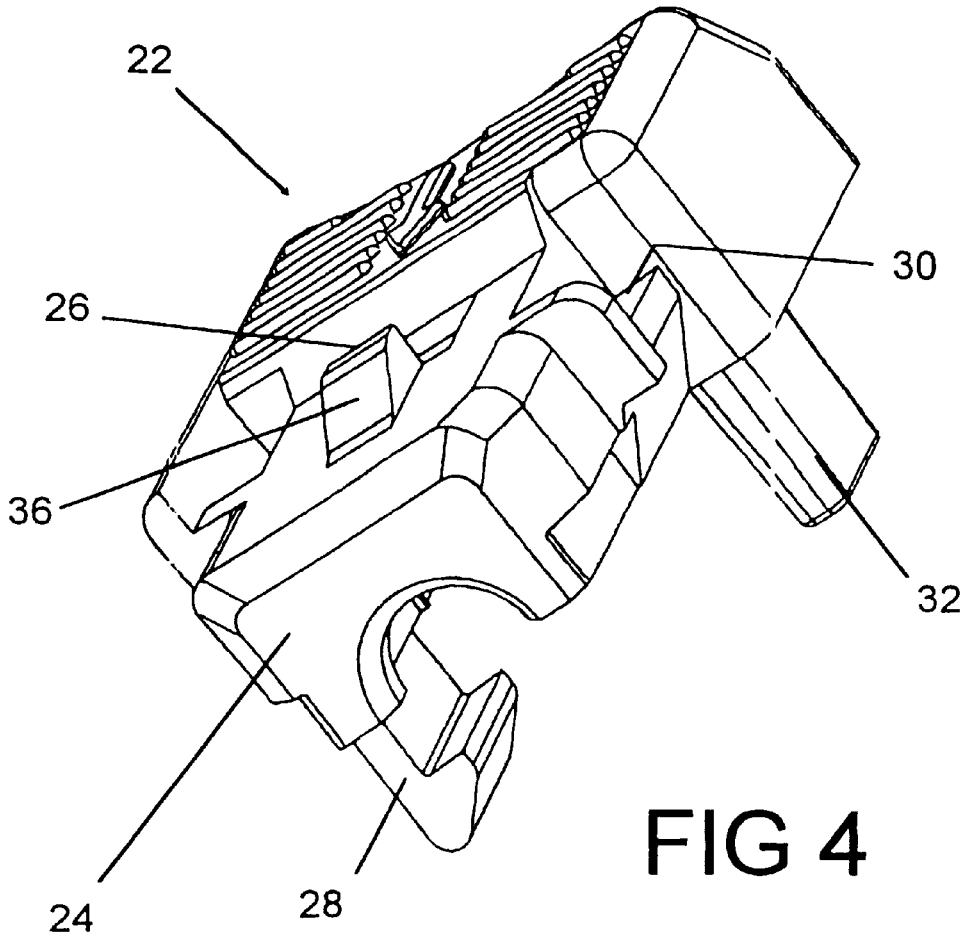
FIG. 4 is a three dimensional view of one of the plug connector housing components showing the exterior and the mating face of the plug connector housing component.
Figure 5:
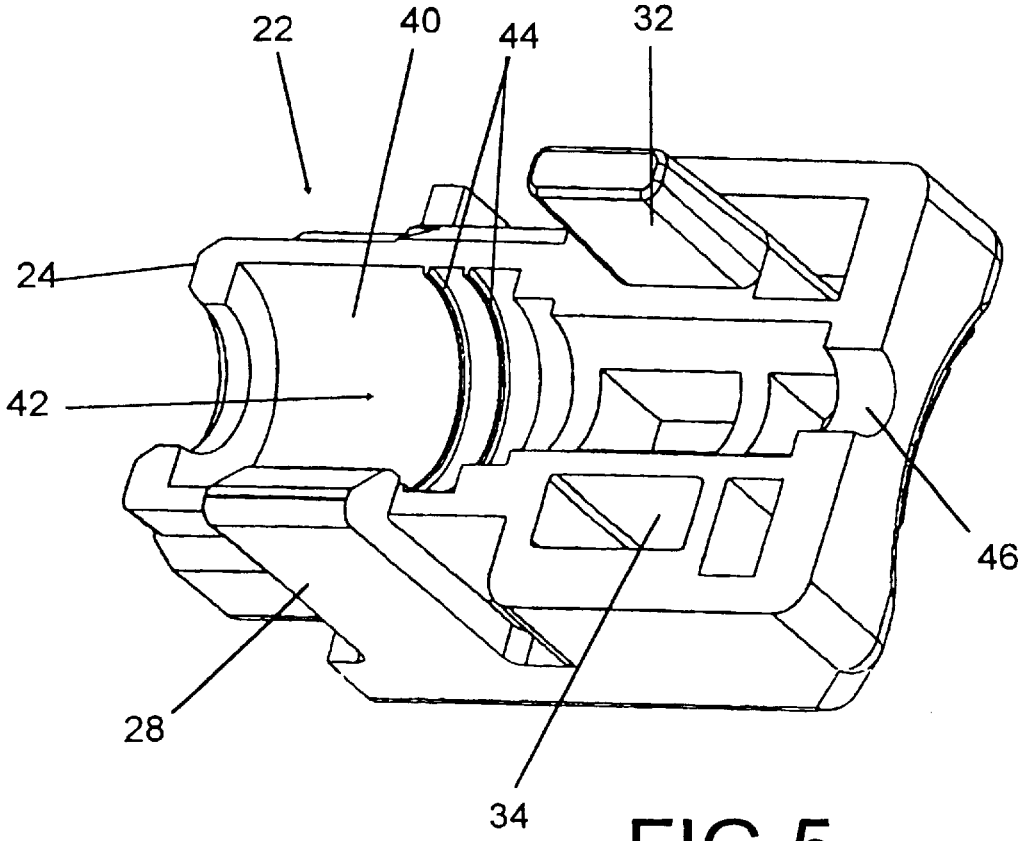
FIG. 5 is a three dimensional view of the plug connector housing component shown in FIG. 4 showing the interior of the housing component.

The coaxial connector assembly 2 shown in FIG. 1 includes a first plug coaxial connector subassembly 4 and a second jack coaxial connector subassembly 6. The plug coaxial connector subassembly 4 includes a plug coaxial connector 10, shown in FIGS. 2A and 2B, that is positioned within a molded plug housing 20, shown in FIGS. 3–5. The jack coaxial connector subassembly 6 includes a jack coaxial connector 50, shown in FIG. 6, that is positioned within a molded jack housing 60, shown in FIGS. 7–9.

Figure 2B:
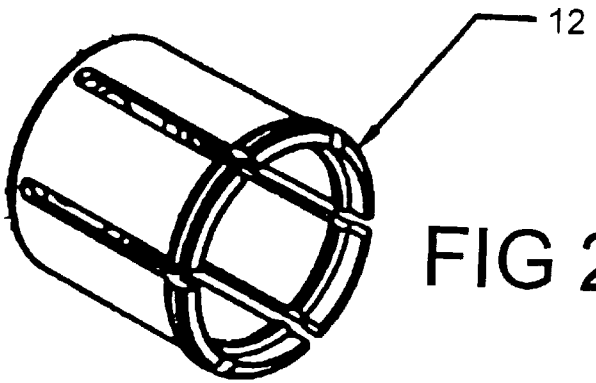
FIG. 2B shows the spring fingers positioned within the collar of the plug coaxial connector of FIG. 2A.
Figure 10:
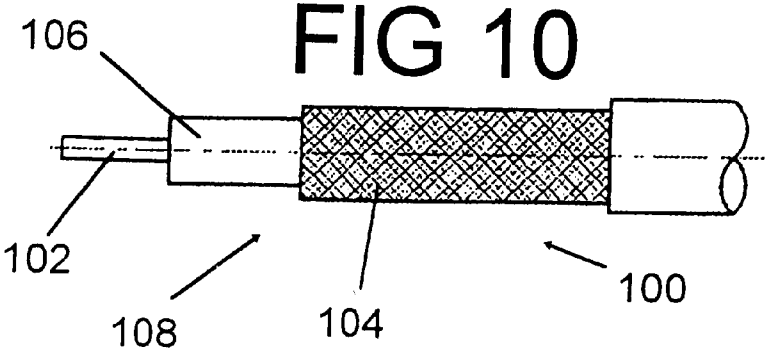
FIG. 10 is a view of a stripped end of a coaxial cable that can be attached to either or both of the plug and jack coaxial connector.

The plug coaxial connector 10 includes a collar 14, in which spring fingers 12, which are shown in FIG. 2B, are located. These spring fingers 12 form part of a quick connect, quick disconnect feature and also serve to connect the braid or outer shield 104 of a coaxial cable 100, as shown in FIG. 10, to another coaxial conductor segment. A ferrule 18 is crimped around the braid 104 to connect the braid to the outer conductor contact. A plug center contact 16, in the form of a socket, is crimped to a center conductor 102, that is separated from the braid 104 by a dielectric core 106. A stripped end 108, suitable for termination to the plug coaxial connector 10, is shown in FIG. 10. The plug coaxial connector 10 is of the type commercially available from Tyco-electronics (AMP) as an SMB In Line Plug connector Part Number 414946-1.

Plug connector 10 is positioned or mounted within the plug housing 20 to form the plug connector subassembly 4. The preferred embodiment of plug housing 20 is formed of two mating hermaphroditic or identical one-piece molded housing components 22, that are injection molded using a conventional molding thermoplastic material, such as acetal. These hermaphroditic housing components 22 can be snapped or latched together in surrounding relationship to the plug connector or terminal 10 that has been previously attached or crimped to a coaxial cable 100. Although the two housing components 22 do not have to be identical, the manufacturing cost of the assembly is reduced if the same part can be used for both halves forming the molded plug housing 20.

Housing component 22 includes a latching member in the form of a raised bump 26 located adjacent to a mating face 24. The plug housing 20 will then have two oppositely facing mating or latching bumps 26 that comprise means for attaching or locking the plug connector subassembly 4 to the jack subassembly 6 to form the mated coaxial connector assembly 2. Each plug housing component 22 also includes a molded housing latch 28, in the form of a deflectable cantilever beam 28 and a latching shoulder 30 located on an opposite side of the molded plug housing component 22. The latch 28 includes a head at its distal end that is configured to first be deflected by and then to mate with the latching shoulder 30 of the companion housing component that forms the other part of the plug housing 20. Each plug housing component 22 also includes an alignment post 32 and an alignment pocket 34 which is dimensioned to receive an alignment post 32 on the companion hermaphroditic housing member. The housing latch 28, the latching shoulder 30, the alignment post 32, and the alignment pocket 34 thus serve to position and latch the two housing components 22 into engagement surrounding a plug connector 10 positioned between the two housing components 22.

Semicylindrical interior surfaces 40 define a compartment 42 into which the plug connector 10 will fit. The portion of the compartment 42 adjacent the mating face 24 has a dimension suitable for receiving the collar 14, which comprises the portion of the plug connector 10 having the largest dimension. Two crush pads 44 in the form of raised molded surfaces will engage the exterior surface of the collar 14 to hold the connector 10 in position. These crush pads not only serve to locate the contact, but also function to prevent vibration or rattling. The ferrule 18, crimped around the cable braid 104 at the rear of the connector 10 will fit within the smaller portion of the compartment 42 between the alignment post 32 and the alignment pocket 34. An opening 46 is formed by two semicylindrical surfaces at the rear of the housing components 22 to form a cable exit 46 through which the terminated coaxial cable 100 will extend.

The latching bumps 26 protrude from upper and lower faces of the molded housing 20 and each includes an inclined or gently sloping forward surface 36 and a rear surface 38 that extends at a steeper angle relative to the housing face from which the bump protrudes. Rear surface 38 will function as a locking surface, making it more difficult to disengage a mating housing latch 66 on the jack housing 60. In other words disengagement of latch 66 from bump 26 will require more force that the mating force required to deflect the latch 66 as it moves across the more gently inclined forward surface 36. The rear surface 38 can even extend at a negative or back angle to enhance the locking engagement between the plug housing 20 and the jack housing 60. USCAR specifications for connectors of this type require a mating force of less than 75 newtons and a disconnect force of more than 110 newtons. The front of the collar 14 of the plug coaxial connector 10 and the spring fingers 12 are slightly recessed relative to the mating face 24 of the housing 20, but the front of the connector 10 is located between the mating face 24 and the beginning of the forward surface 36 of the raised bump 26. As will be described later in more detail, the relative position of the bump 26 and the plug connector spring fingers 12 are important is assuring that the mating force between the two connector subassemblies 4 and 6 does not exceed a desirable upper limit.

Figure 6:
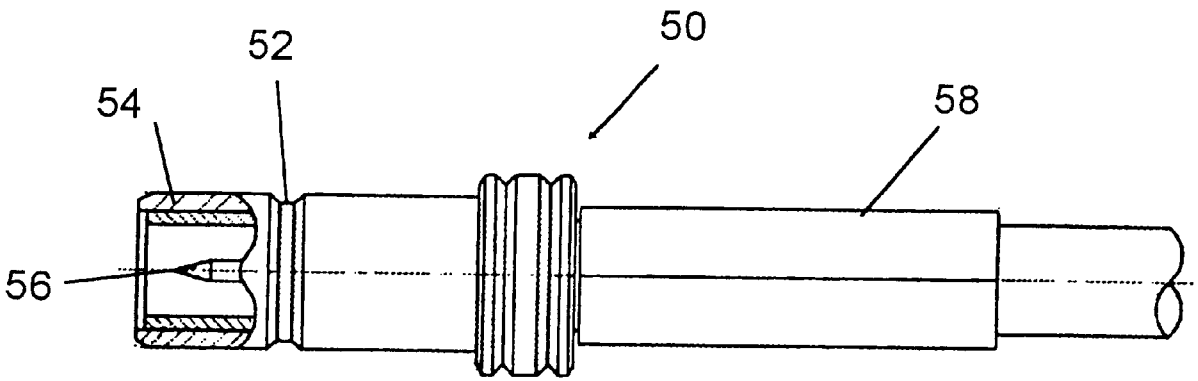
FIG. 6 is a view of a coaxial jack connector, partially broken away to reveal the center pin.
Figure 7:
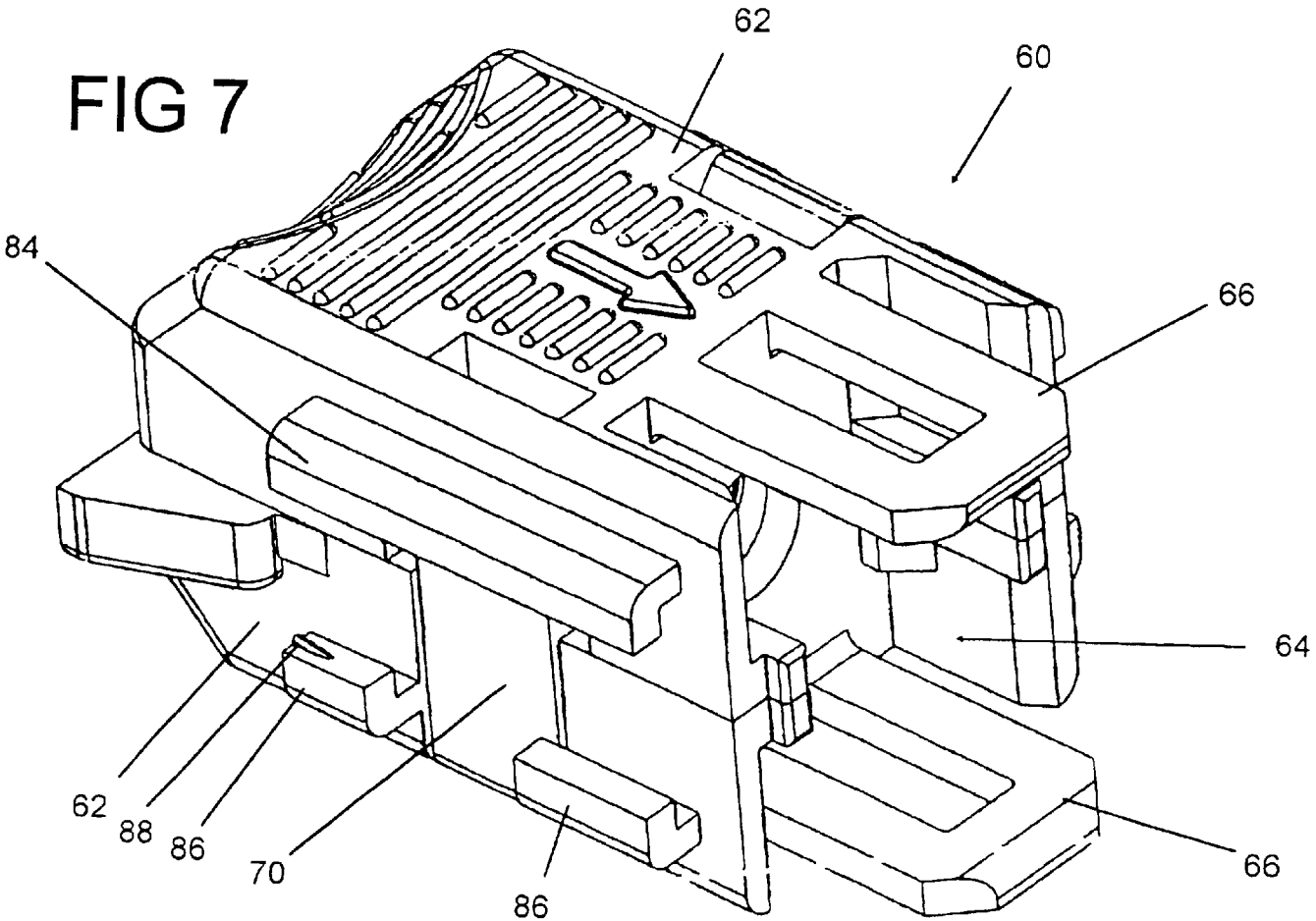
FIG. 7 is a three dimensional view of the molded jack connector housing showing the two mated hermaphroditic housing components.

The jack connector 50 comprising part of the jack connector subassembly 6 is shown in FIG. 6. Jack connector 50 has a groove 52 that is spaced from its front beveled end, and the groove 52 extends completely around the exterior of the connector 50. A center contact 56, in the form of a pin is spaced from the other contact sleeve 54, and the two separate conductors are separated by a dielectric, not shown. A mounting ring is located between the groove 52 and a rear section or ferrule 58 that is attached to the outer cable conductor or braid 104. The jack connector 50 can be attached to the stripped end 108 of a coaxial conductor 100, and in the preferred embodiment an existing jack connector available from Tycoelectronics (AMP) and sold as an SMB In Line Jack, Part Number 414948 is employed.

When the plug coaxial connector 10 is mated to the jack coaxial connector 50, the spring fingers 12 are first cammed outwardly as they engage the beveled front of jack contact sleeve 54. The deflected spring fingers 12 then slide along the exterior of the jack until the mating ridges on the ends of the spring fingers fit within the groove 52 so the that spring fingers 12 return to a neutral position. However, the disconnect force required to extract the spring finger ridges from groove 52 is approximately equal to the maximum connect force between the two connectors that occurs when the spring fingers are first outwardly deflected. Thus the plug coaxial connector 10 cannot be said to be locked to the jack coaxial connector 50, even when the two connectors are fully mated. Also the connectors cannot be disengaged by simply pulling them apart, so that a tug on a cable cannot disconnect the two connectors.

Figure 8:
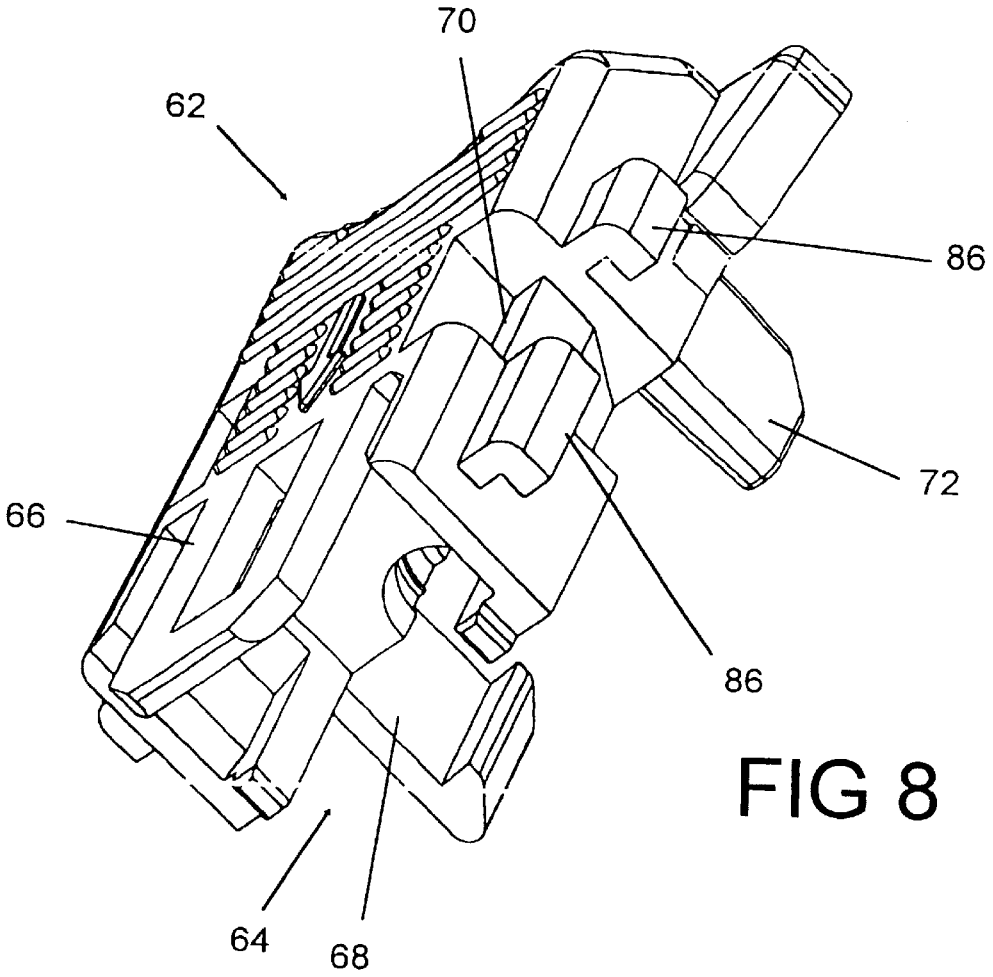
FIG. 8 is a three dimensional view of one molded jack connector housing component showing the mating face and the exterior of the housing component.
Figure 9:
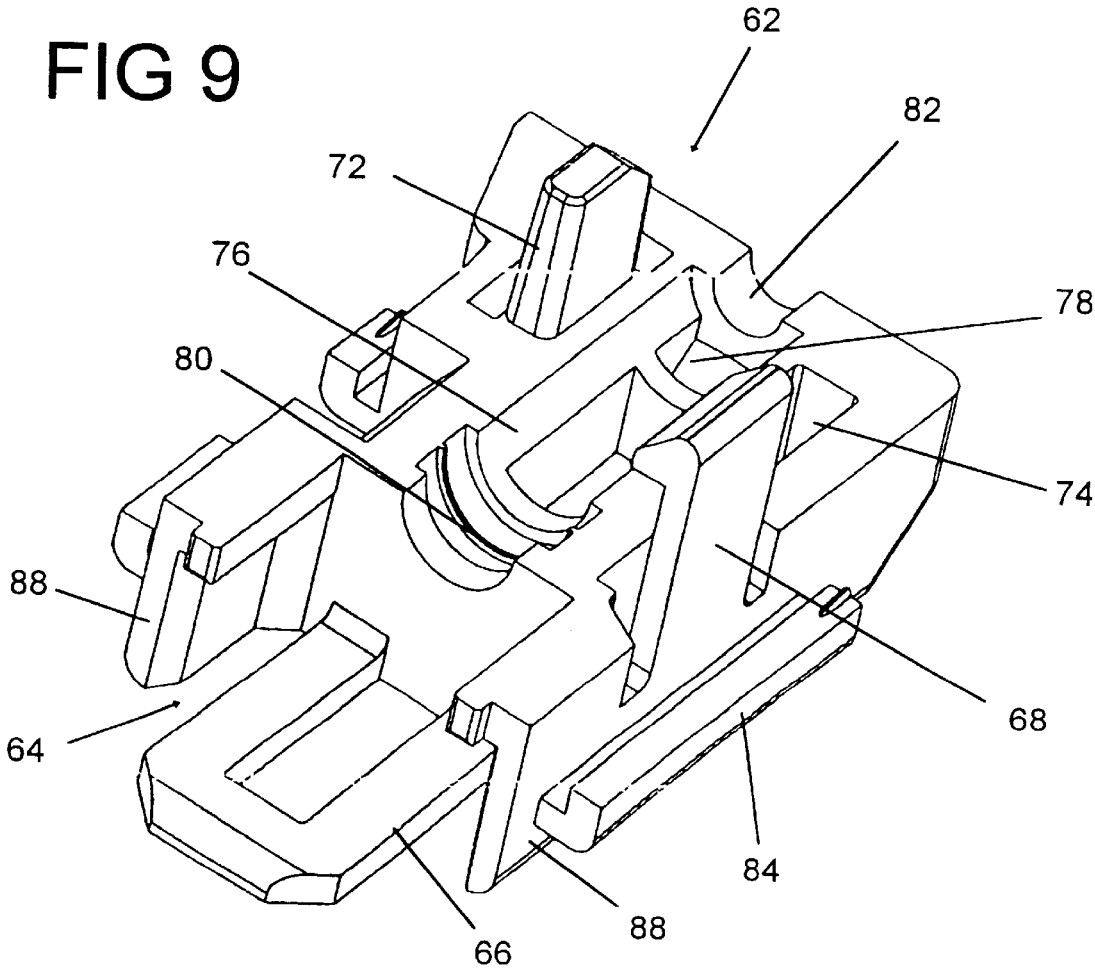
FIG. 9 is a three dimensional view of the molded jack connector housing shown in FIG. 8 showing the interior of the housing component.

The molded jack housing 60, in which the jack connector 50 is positioned is formed by two hermaphroditic or identical jack housing components 62, depicted in FIGS. 8 and 9. The jack housing component 62 is formed by injection molding, and a thermoplastic, such as acetal can be used to fabricated the one piece housing component 62. FIG. 8 shows the exterior of one jack housing component 62, and FIG. 9 shows details of the interior of the same component 62. A deflectable cantilever beam latching member 66 extends forward from the mating face 64 of the jack housing component 62. The latching member 66 has two arms, one end of which extends as an integral part of the housing component 62, with an integral transverse arm, joining the two deflectable arms to form the deflectable cantilever latching member 66. The two axially extending arms are spaced apart by a distance that is at least equal to the width of the raised bump 26 to which latching member 66 will be engaged. The transverse arm at the end of latching beam 66 will engage the forward bump surface 36 during mating and will snap behind the rear bump surface 38 when the plug housing 20 and the jack housing 60 are latched and locked in fully mating engagement. The timing of the engagement of the latching members 26 and 66 relative to the engagement of the plug connector 10 and jack connector So will be subsequently discussed with reference to FIG. 11.

Each jack housing component 62 includes a cantilever beam housing latch 68 on one side and a housing latch shoulder 70 on the other side. The latch shoulder 70 is dimensioned to mate with the housing latch 68 when the two jack housing components 62 are assembled to form the two piece molded jack housing 60. An alignment post 72 on each housing component fits within an alignment pocket 74 on the other housing component when the two hermaphroditic or identical housing components 62 are assembled in at least partially surrounding relationship to the jack connector 50.

As shown in FIG. 9, each jack housing component 62 includes semi cylindrical mounting surfaces 76 forming an interior compartment 78 in which the rear portion of the jack connector 50 can be positioned. A crush ring 80 is located in a central recess in which the mounting ring at the center of the jack connector 50 is positioned. With the jack connector positioned within the compartment 78 in this manner, the front outer contact portion 54 and the groove 52 will extend beyond the housing face from which the latches 66 protrude. Sidewalls 88 also extend from this face so that the sidewalls 88 and the latches 66 form a cavity to receive the mating portion of the plug connector from which the raised bumps 26 extend. The front contact portion 54 will also be located within this cavity and will be inserted into the collar portion 14 of the plug connector 10 in the fully mated configuration.

The jack connector housing components 62 has have two sets of rails for mounting the entire coaxial connector assembly on a protruding member that will fit between the rails. Plastic member having fur tree mounting posts, sometimes colloquially referred to as Christmas trees, insertable through holes in bulkheads, typically included a rib extending parallel to the bulkhead. This rib can be received between the two sets of rails 84 and 86 on the jack connector housing 60 so that the entire assembly can be firmly mounted on a bulkhead. The first rail 84 is a continuous rail, shown in FIG. 9 that is located at the base of the housing latch 68. The second set of rails is formed by two rails 86 located on opposite sides of the housing latching shoulder 70, as shown in FIG. 8. This provides space for the latching beam 68 on the opposite housing component 62 to engage the opposed latching shoulder 70. A protrusion 88 at the end of rail 86 provides a means for securing a latching rib mounted to the bulkhead. A conventional latching rib of this type can be deflected outward into engagement with the protrusion 88 by a sloping surface on the adjacent side of the housing component 62. The rails 84, 86 can be mounted on the rib either before or after the plug connector subassembly 4 is mated to the jack connector assembly 6.

Figure 11:
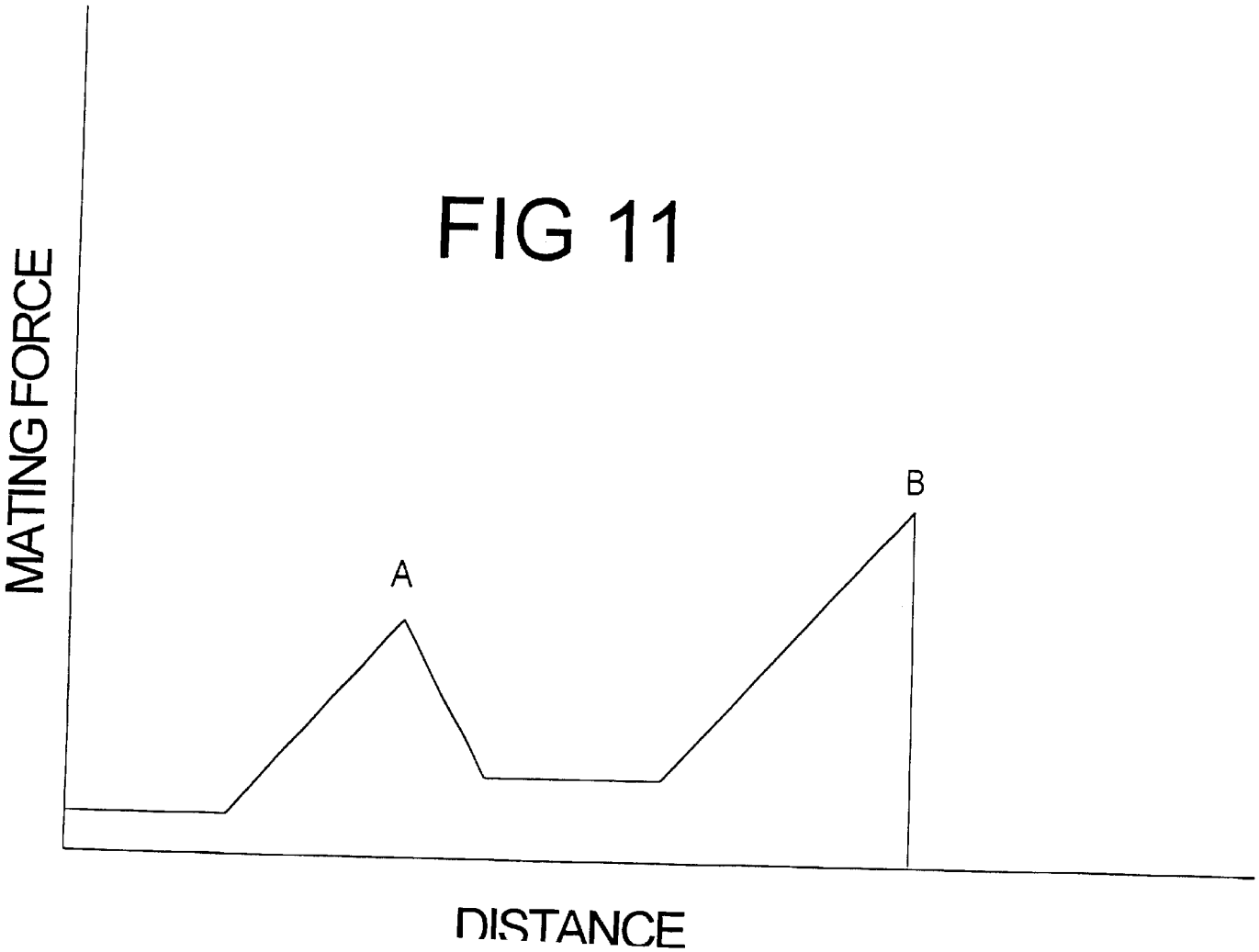
FIG. 11 is a graphical representation of the forces encountered as the plug connector assembly is mated to the jack connector assembly.

One of the principal goals of this coaxial connector assembly is to provide plug and jack connectors that can be locked together so that it requires significantly greater force to inadvertently unmate the connectors than is required to mate the connectors, but at the same time to keep the overall mating force between the connectors within acceptable limits. In order to accomplish this, the mating force peak between the plug connector 10 and the jack connector 50 should not overlap the mating force peak between the latch 66 and the raised bump 26. This is accomplished by positioning the plug and jack connectors 10, 50 in the housings 20, 60 so that the spring fingers 12 have been deflected to their maximum before the jack latches 66 engage the forward surface 36 of the raised bump 26. As shown in FIG. 11, the peak force between the plug connector 10 and the jack connector 50 occurs at point A, well before the peak engagement force between the latching members 26, 66 at point B. As shown in FIG. 11 there is initially negligible mating force between the two connectors until the spring fingers 12 are deflected outward upon engagement with the front of the jack connector 50, at which the mating force increases until the spring fingers 12 are at their maximum deflection, corresponding to position A in FIG. 11. As the plug and jack connectors continue to move to a fully mated configuration, there a frictional force, dependent upon the spring force exerted by the deflected spring, is still present. This frictional force is, however, significantly less than the peak force at A. When the lathing beam 66 engages the forward surface 36 on the plug, an engagement force between the two mating connector housing increases until a peak force is reached at B. corresponding to maximum deflection of latching beam 66. The latching beam then snaps behind the rear surface 38 on the bump 26. Since the peak mating force between the two connectors occurred at point A, well before the peak engagement force due to deflection of the molded cantilever beam 66 at B, these two force peaks are not additive, and the maximum mating force can remain within acceptable limits. However, the disengagement force between the beam 66 and the bump 26 is even larger because of the slope of the rear surface 38, so that the two connectors subassemblies 4, 6 can be locked together and cannot be disengaged by the application of a tensile force to either or both coaxial cables.

The invention disclosed by the representative embodiment is especially suitable for use for connecting two coaxial cables. However, the same approach can be used to connect a coaxial cable with a printed circuit board connector. The representative embodiments depicted herein are also intended for use with a single connector assembly, but multiple coaxial lines could also be connected employing the same approach. The invention is therefore not limited to use in the preferred and representative embodiment depicted herein, and equivalent structures apparent to those of ordinary skill in the art could employ the same invention that is defined by the following claims.

I claim:

1. A press-fit type coaxial connector assembly comprising a plug coaxial assembly matable with a jack coaxial assembly, wherein:

the plug coaxial assembly comprises a plug coaxial connector and a molded plug housing comprising first and second plug housing components latched together around the plug coaxial connector, and;

the jack coaxial assembly comprises a jack coaxial connector and a molded jack housing comprising first and second jack housing components latched together around the jack coaxial connector; wherein the plug coaxial connector is latched to the jack coaxial connector when mated and wherein the molded plug housing is separately latched to the molded jack housing when the plug coaxial assembly is mated to the jack coaxial assembly.

2. The coaxial connector assembly of claim 1 wherein the plug coaxial connector is latched to the jack coaxial connector by spring fingers on one of the coaxial connectors received within a peripheral groove on the other of the coaxial connectors.

3. The coaxial connector assembly of claim 2 wherein the spring fingers are surrounded by a collar on one coaxial connector, the collar being received within a recess formed within one of the molded plug and jack housings in which the coaxial connector with the spring fingers is positioned.

4. The coaxial connector assembly of claim 3 wherein the plug coaxial connector includes the collar and wherein a portion of the jack connector protrudes beyond the mating face of the molded jack housing and is received within the collar on the plug connector when the plug coaxial assembly is mated to the jack coaxial assembly.

5. The coaxial connector assembly of claim 1 wherein the plug housing components comprise identical hermaphroditic plug components and the jack housing components comprise identical hermaphroditic jack components.

6. The coaxial connector assembly of claim 1 wherein the molded jack housing and the molded plug housing each include semi-cylindrical surfaces on each respective housing components to form a compartment in which the respective connector is positioned.

7. The coaxial connector assembly of claim 1 wherein each molded housing includes crush pads comprising means for securing connectors in respective housings.

8. The coaxial connector assembly of claim 1 wherein both the plug coaxial connector and the jack coaxial connector include means for attaching the respective connector to a coaxial cable.

9. The coaxial connector assembly of claim 1 wherein one of the molded housings includes spaced apart rails on one side for mounting the coaxial connector assembly on a companion member insertable between the rails.

10. A press-fit type coaxial connector assembly comprising mating plug and jack coaxial connectors, the plug coaxial connector being mounted in a molded plug housing and the jack coaxial connector being mounted in a molded jack housing, the plug housing including a plug latch and the jack housing including a jack latch, the plug latch being matable with the jack latch with an engagement force, the plug latch being unmatable from the jack latch with a disengagement force, the disengagement force being greater than the engagement force so that the plug coaxial connector and the jack coaxial connector can be locked in a mating configuration.

11. The coaxial connector assembly of claim 10 wherein one of the plug latch and the jack latch comprises a deflectable cantilever beam and the other of the plug latch and the jack latch comprise a bump, the deflectable cantilever beam being deflected by the bump as the plug and jack coaxial connectors are mated.

12. The coaxial connector assembly of claim 11, wherein the bump has a forward surface slanted at an acute angle relative to a housing side from which the bump protrudes and the bump has a rear surface extending at a greater angle relative to the side from which the bump protrudes, so that the force required to deflect the deflectable cantilever beam is less as the plug and jack connectors are mated than when the plug and jack connectors are unmated.

13. The coaxial connector assembly of claim 12 wherein the cantilever beam comprises a portion of the molded jack housing and the bump comprises a portion of the molded plug housing.

14. The coaxial connector assembly of claim 10 wherein a connect force for mating the plug and jack coaxial connector is approximately equal to a disconnect force for unmating the plug and jack coaxial connectors.

15. The coaxial connector assembly of claim 14 wherein one of the plug and jack coaxial connectors includes spring figures engagable with and disengagable from a groove of the other of the plug and jack connectors.

16. A coaxial connector assembly comprising a first subassembly matable with a second subassembly, wherein:

the first subassembly comprises a first coaxial connector positioned in a first molded housing, the first coaxial connector including spring fingers, the first molded housing including a first latching member; and the second subassembly comprises second coaxial connector positioned in a second molded housing, the second coaxial connector including a groove enagable with the spring fingers to form a quick connect-disconnect connection, the second molded housing including a second latching member matable with the first latching member to lock the first and second subassemblies in mating engagement, wherein:

the spring fingers and the groove are positioned relative to the first and second latching members respectively so that a first mating force peak attributable to mating the first coaxial connector to the second coaxial connector occurs prior to a second mating force peak attributable to mating the first latching member to the second latching member so that the first and second mating force peaks do not overlap as the first subassembly is mated to the second subassembly.

17. The coaxial connector assembly of claim 16 wherein the first coaxial connector comprises a plug coaxial connector and the second coaxial connector comprises a jack coaxial connector.

18. The coaxial connector assembly of claim 16 wherein one of the first and second latching members comprises a molded deflectable latching beam and the other of the first and second latching members comprises a raised bump over which the latching beam is deflected as the first subassembly is mated to the second subassembly.

19. The coaxial connector assembly of claim 18 wherein a force for engaging the first and second coaxial connectors is substantially the same as a force for disengaging the first and second coaxial connectors and wherein a force for disengaging the deflectable latching beam from the bump is greater than a force for engaging the deflectable latching beam with the bump so that the deflectable latching beam and the bump comprise means for locking the first and second subassemblies together when the first coaxial connector is mated to the second coaxial connector.

20. A coaxial connector assembly comprising a plug coaxial assembly matable with a jack coaxial assembly, wherein:

the plug coaxial assembly comprises a plug coaxial connector and a molded plug housing comprising first and second plug housing components latched together around the plug coaxial connector;

the jack coaxial assembly comprises a jack coaxial connector and a molded jack housing comprising first and second jack housing components latched together around the jack coaxial connector; wherein the plug coaxial connector is latched to the jack coaxial connector when mated and wherein the molded plug housing is separately latched to the molded jack housing when the plug coaxial assembly is mated to the jack coaxial assembly;

wherein the plug coaxial connector is latched to the jack coaxial connector by spring fingers on one of the coaxial connectors received within a peripheral groove on the other of the coaxial connectors;

wherein the spring fingers are surrounded by a collar on one coaxial connector, the collar being received within a recess formed within one of the molded plug and jack housings in which the coaxial connector with the spring fingers is positioned;

wherein the plug coaxial connector includes the collar and wherein a portion of the jack coaxial connector protrudes beyond the mating face of the molded jack housing and is received within the collar on the plug coaxial connector when the plug coaxial assembly is mated to the jack coaxial assembly; and, wherein the jack coaxial connector includes latching beams extending beside the portion of the jack coaxial connector protruding beyond the mating face of the molded jack housing.

21. A coaxial connector assembly comprising a plug coaxial assembly matable with a jack coaxial assembly, wherein:

the plug coaxial assembly comprises a plug coaxial connector and a molded plug housing comprising first and second plug housing components latched together around the plug coaxial connector;

the jack coaxial assembly comprises a jack coaxial connector and a molded jack housing comprising first and second jack housing components latched together around the jack coaxial connector; wherein the plug coaxial connector is latched to the jack coaxial connector when mated and wherein the molded plug housing is separately latched to the molded jack housing when the plug coaxial assembly is mated to the jack coaxial assembly;

wherein the plug coaxial connector is latched to the jack coaxial connector by spring fingers on one of the coaxial connectors received within a peripheral groove on the other of the coaxial connectors;

wherein the spring fingers are surrounded by a collar on one coaxial connector, the collar being received within a recess formed within one of the molded plug and jack housings in which the coaxial connector with the spring fingers is positioned;

wherein the plug coaxial connector includes the collar and wherein a portion of the jack coaxial connector protrudes beyond the mating face of the molded jack housing and is received within the collar on the plug coaxial connector when the plug coaxial assembly is mated to the jack coaxial assembly; and, wherein the molded jack housing includes latching beams extending beside the portion of the jack coaxial connector protruding beyond the mating face of the molded jack housing.

* * * * *